US007651359B2

(12) United States Patent
Scherer et al.

(10) Patent No.: US 7,651,359 B2
(45) Date of Patent: Jan. 26, 2010

(54) ELECTRICAL CONNECTOR ASSEMBLY

(75) Inventors: Richard J. Scherer, Austin, TX (US); Joseph N. Castiglione, Cedar Park, TX (US); Michael L. Black, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 22 days.

(21) Appl. No.: 11/854,996

(22) Filed: Sep. 13, 2007

(65) Prior Publication Data

US 2008/0070436 A1 Mar. 20, 2008

Related U.S. Application Data

(60) Provisional application No. 60/825,679, filed on Sep. 14, 2006.

(51) Int. Cl.
*H01R 13/625* (2006.01)

(52) U.S. Cl. ..... 439/345; 439/476.1; 439/752

(58) Field of Classification Search ..... 439/345, 439/346, 347, 476.1, 752
See application file for complete search history.

(56) References Cited

U.S. PATENT DOCUMENTS

| | | | | |
|---|---|---|---|---|
| 4,406,512 | A | 9/1983 | Schell | |
| 4,976,628 | A | 12/1990 | Fedder | |
| 4,984,992 | A | 1/1991 | Beamenderfer et al. | |
| 5,116,230 | A | 5/1992 | Dechelette et al. | |
| 5,125,854 | A * | 6/1992 | Bassler et al. | 439/607 |
| 5,184,965 | A | 2/1993 | Myschik et al. | |
| 5,207,593 | A * | 5/1993 | Bogiel | 439/352 |
| 5,222,898 | A | 6/1993 | Fedder et al. | |
| 5,421,735 | A | 6/1995 | Dechelette | |
| 5,464,356 | A * | 11/1995 | Nebeshima et al. | 439/752 |
| 5,554,038 | A | 9/1996 | Morlion et al. | |
| 5,607,326 | A * | 3/1997 | McNamara et al. | 439/608 |
| 5,839,923 | A * | 11/1998 | Yoshida | 439/752 |
| 5,964,621 | A | 10/1999 | Wolla et al. | |
| 6,152,771 | A | 11/2000 | Juntwait | |
| 6,238,232 | B1 | 5/2001 | Briggs, Jr. et al. | |
| 6,368,128 | B1 * | 4/2002 | Backer et al. | 439/189 |
| 6,688,920 | B2 | 2/2004 | Lehner et al. | |
| 6,705,885 | B1 * | 3/2004 | Lin et al. | 439/476.1 |
| 6,743,050 | B1 | 6/2004 | Wu | |

(Continued)

FOREIGN PATENT DOCUMENTS

EP 0 570 181 A2 11/1993

(Continued)

OTHER PUBLICATIONS

"Single Signal Carrier Systems (SCC™)", Joy Signal Technology, Chico, California, USA, [retrieved from the internet on Aug. 28, 2006], URL <www.joysignal.com/ssc.htm>.

*Primary Examiner*—James Harvey
(74) *Attorney, Agent, or Firm*—Johannes P. M. Kusters

(57) ABSTRACT

An electrical cable assembly includes a carrier having an insulating housing and at least one retention clip for managing and securing terminated cable assemblies to the carrier. The side exterior walls of the insulating housing are configured to enable side-to-side and end-to-end placement of a plurality of carriers for mating to a pin header, resulting in a high speed, high density electrical connector system.

7 Claims, 12 Drawing Sheets

U.S. PATENT DOCUMENTS

| | | | | |
|---|---|---|---|---|
| 6,780,069 | B2 * | 8/2004 | Scherer et al. | 439/752 |
| 6,921,289 | B2 * | 7/2005 | Takahashi et al. | 439/507 |
| 7,001,187 | B2 | 2/2006 | Terunuma et al. | |
| 7,044,793 | B2 | 5/2006 | Takemasa | |
| 2007/0010112 | A1 * | 1/2007 | Makino | 439/76.2 |
| 2008/0070436 | A1 * | 3/2008 | Scherer et al. | 439/345 |

FOREIGN PATENT DOCUMENTS

| | | |
|---|---|---|
| JP | 2000-067980 | 3/2000 |

* cited by examiner

ELECTRICAL CONNECTOR ASSEMBLY

REFERENCE TO CROSS-RELATED APPLICATIONS

The present application claims priority to U.S. Provisional Patent Application 60/825,679, filed Sep. 14, 2006.

TECHNICAL FIELD

The present invention relates to high speed electrical connectors. In particular, the present invention relates to electrical connectors that provide high signal line density while also providing shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as signal transmission times) have been slow when compared to the length of time required for a signal to propagate through a conductor in the interconnect or in the printed circuit board. As user requirements grow more demanding with respect to both interconnect sizes and signal transmission times, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY OF THE INVENTION

One aspect of the invention described herein provides a carrier for use with an electrical connector assembly. In one embodiment according to the invention, the carrier comprises an insulating housing having a front exterior wall, laterally extending side exterior walls, a plurality of laterally extending interior walls, at least one set of retention clip apertures disposed on at least one of the side exterior walls, and a plurality of pin insertion apertures disposed on the front exterior wall. The side exterior walls of the insulating housing are configured to enable side-to-side and end-to-end placement. In addition, the carrier comprises at least one retention clip having a plurality of retention clip ribs extending from a back, the retention clip disposed in the insulating housing such that the retention clip ribs mate with the retention clip apertures in the insulating housing.

Another aspect of the invention described herein provides an electrical connector assembly. In one embodiment according to the invention, the electrical connector assembly comprises a carrier and a plurality of terminated cable assemblies. The carrier comprises an insulating housing having a front exterior wall, laterally extending side exterior walls, a plurality of laterally extending interior walls, at least one set of retention clip apertures disposed on at least one of the side exterior walls, and a plurality of pin insertion apertures disposed on the front exterior wall. The side exterior walls of the insulating housing are configured to enable side-to-side and end-to-end placement. In addition, the carrier comprises at least one retention clip having a plurality of retention clip ribs extending from a back, the retention clip disposed in the insulating housing such that the retention clip ribs mate with the retention clip apertures in the insulating housing. Each terminated cable assembly comprises an electrical cable attached to a termination device, wherein the termination device has a front face and at least one female contact lying substantially parallel to a longitudinal axis of the terminated cable assembly. The plurality of terminated cable assemblies is disposed in the carrier such that the front face of each termination device is in contact with the interior surface of the housing.

Yet another aspect of the invention described herein provides an electrical connector system. In one embodiment according to the invention, the electrical connector system comprises a plurality of electrical connector assemblies and a pin header configured to receive the plurality of electrical connector assemblies. Each of the electrical connector assemblies comprises a carrier and a plurality of terminated cable assemblies. The carrier comprises an insulating housing having a front exterior wall, laterally extending side exterior walls, a plurality of laterally extending interior walls, at least one set of retention clip apertures disposed on at least one of the side exterior walls, and a plurality of pin insertion apertures disposed on the front exterior wall. The side exterior walls of the insulating housing are configured to enable side-to-side and end-to-end placement. In addition, the carrier comprises at least one retention clip having a plurality of retention clip ribs extending from a back, the retention clip disposed in the insulating housing such that the retention clip ribs mate with the retention clip apertures in the insulating housing. Each terminated cable assembly comprises an electrical cable attached to a termination device, wherein the termination device has a front face and at least one female contact lying substantially parallel to a longitudinal axis of the terminated cable assembly. The plurality of terminated cable assemblies is disposed in the carrier such that the front face of each termination device is in contact with the interior surface of the housing.

BRIEF DESCRIPTION OF THE DRAWINGS

The present invention will be further described with reference to the accompanying drawings wherein like reference numerals refer to like parts in the several views, and wherein.

DETAILED DESCRIPTION

Figure 1:
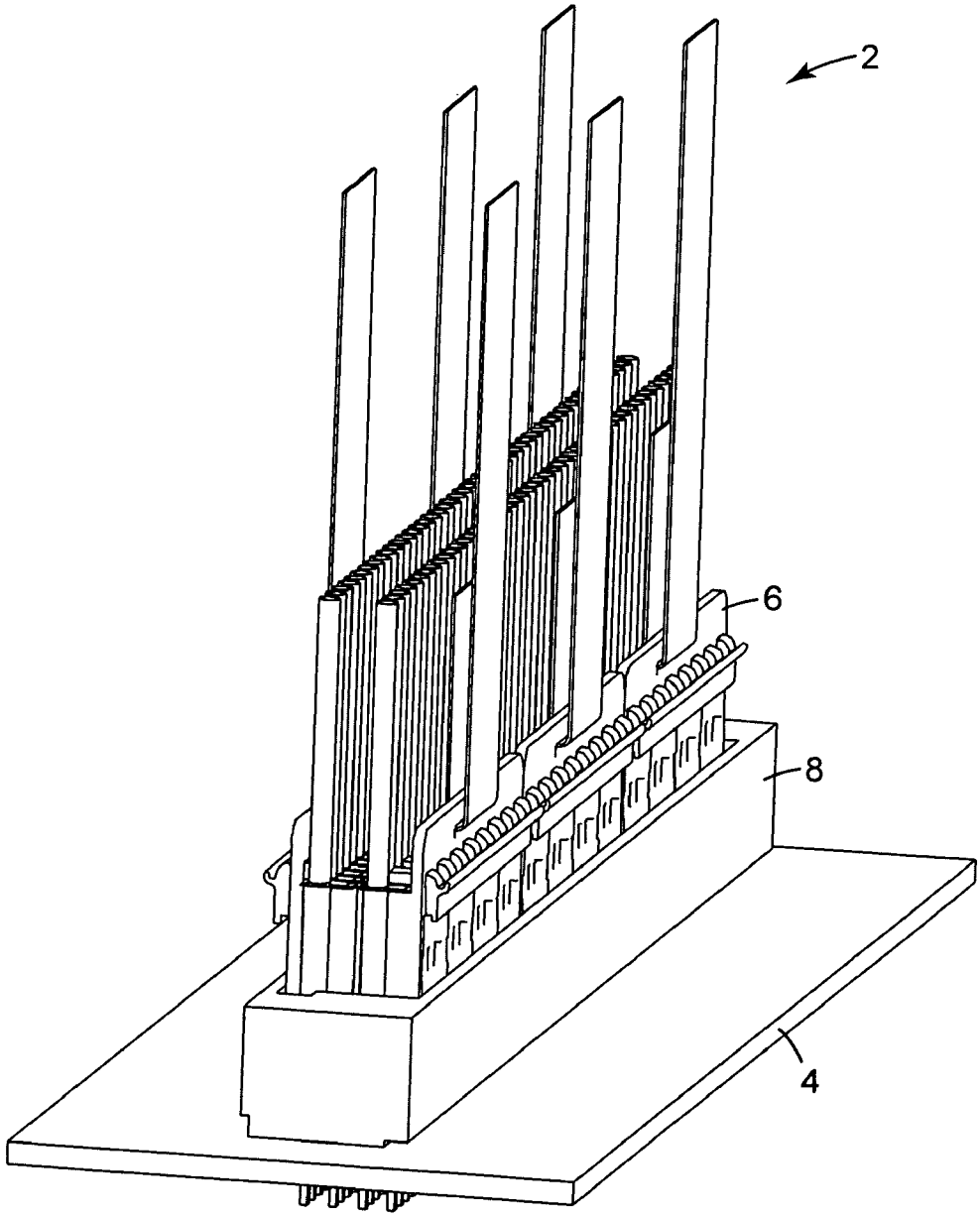
FIG. 1 is a perspective view of an exemplary embodiment of an electrical connector assembly according to the present invention.
Figure 2:
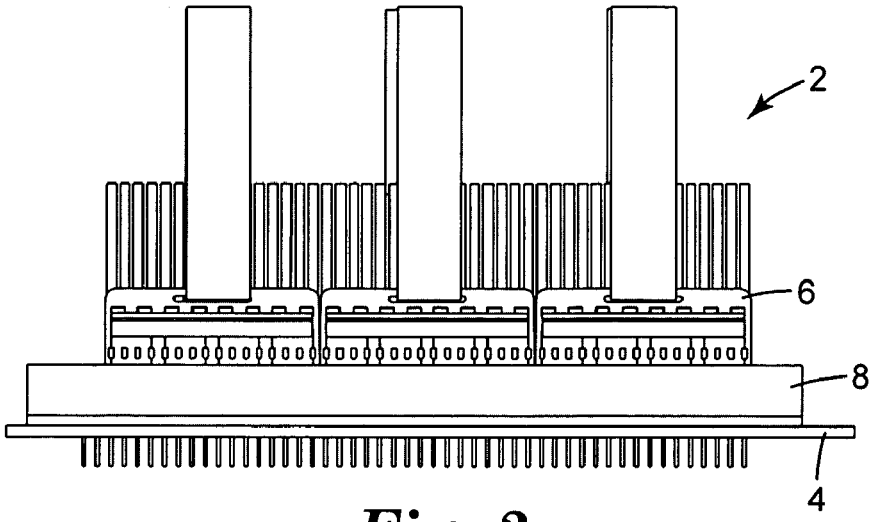
FIG. 2 is a front view of the electrical connector assembly of FIG. 1.
Figure 3:
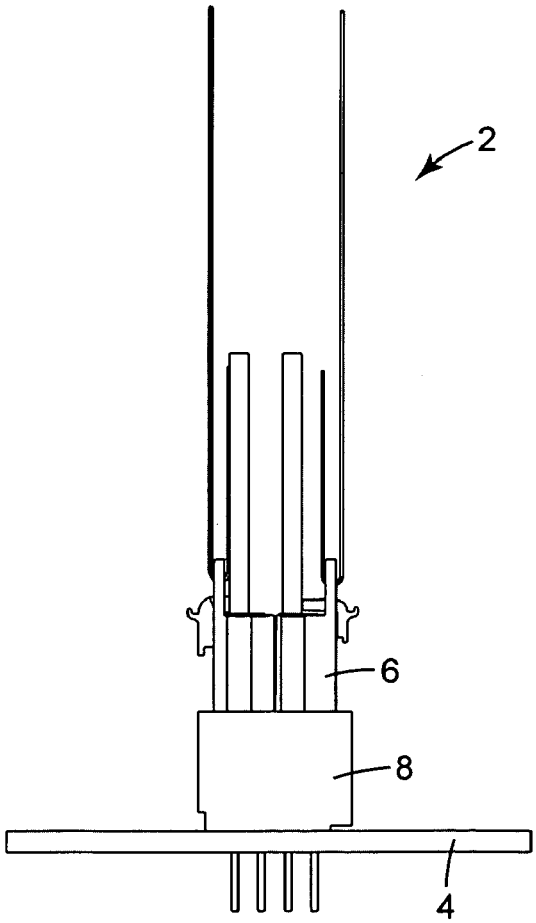
FIG. 3 is a side view of the electrical connector assembly of FIG. 1.
Figure 4:
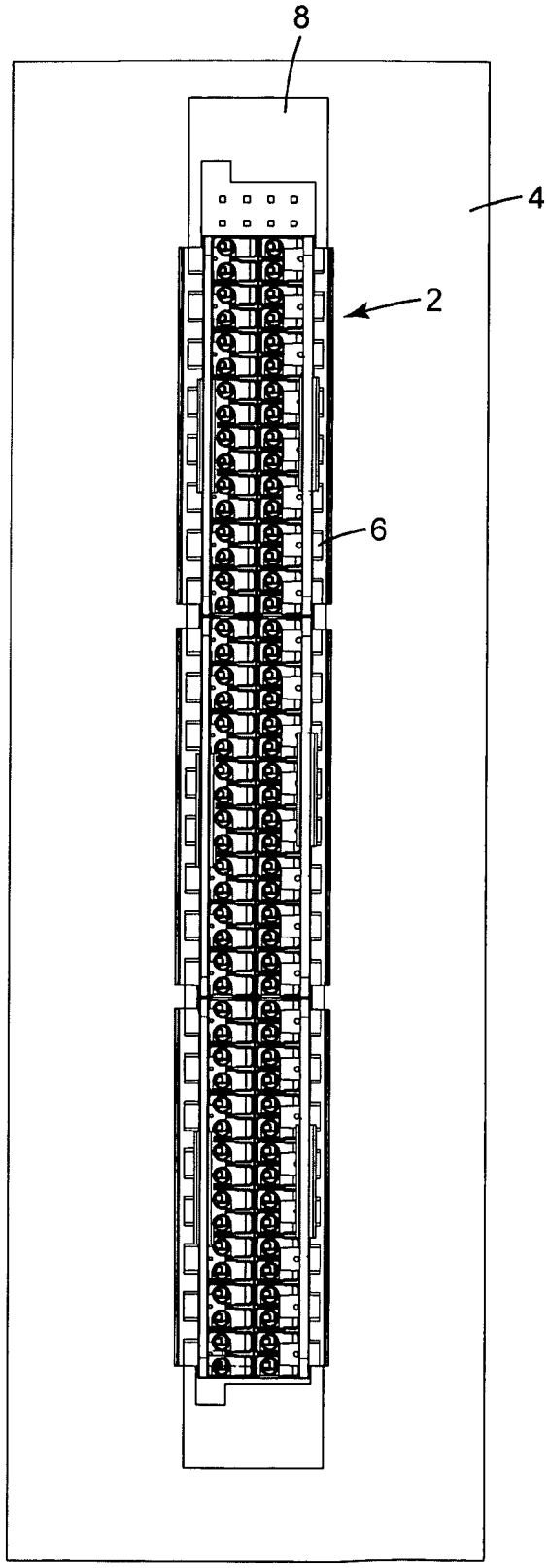
FIG. 4 is a top view of the electrical connector assembly of FIG. 1.
Figure 5:
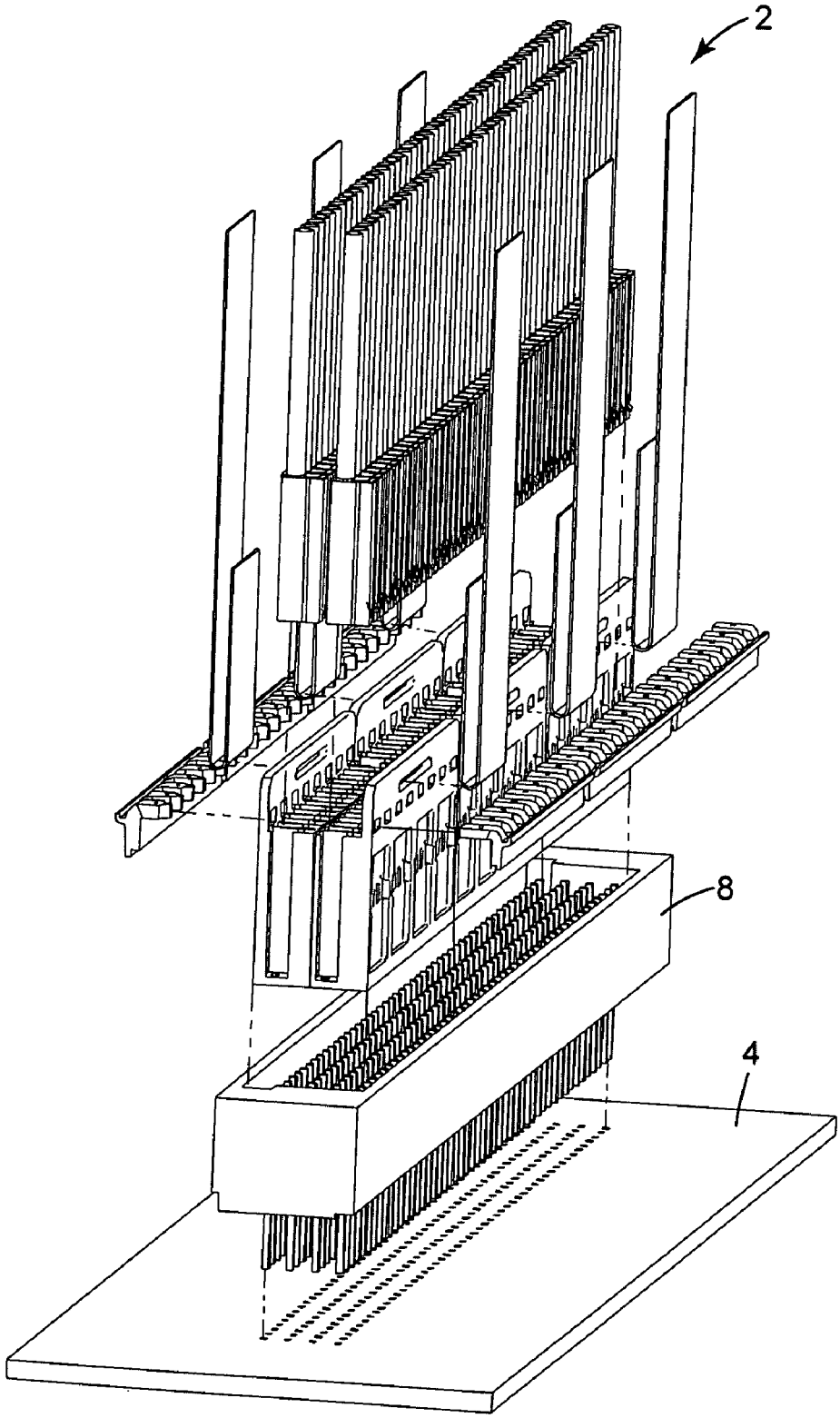
FIG. 5 is an exploded view of the electrical connector assembly of FIG. 1.

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

FIGS. 1 through 5 illustrate different views of one exemplary embodiment of an electrical connector system according to the present invention. Electrical connector system 2 is used in conjunction with printed circuit board 4. As shown, a plurality of electrical cable assemblies 6 is mated to pin header 8, which is in turn connected to printed circuit board 4. Electrical cable assemblies 6 can be placed side-to-side and end-to-end into pin header 8 such that potentially all pin positions in pin header 8 can be used.

Figure 6:
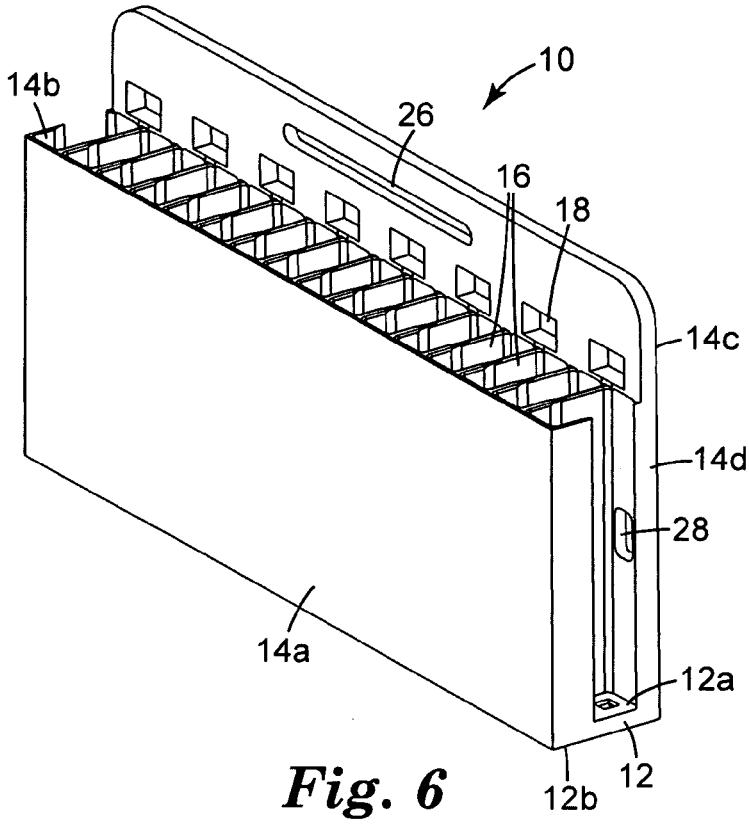
FIGS. 6 and 7 are perspective views of an exemplary embodiment of a carrier housing according to the present invention.
Figure 7:
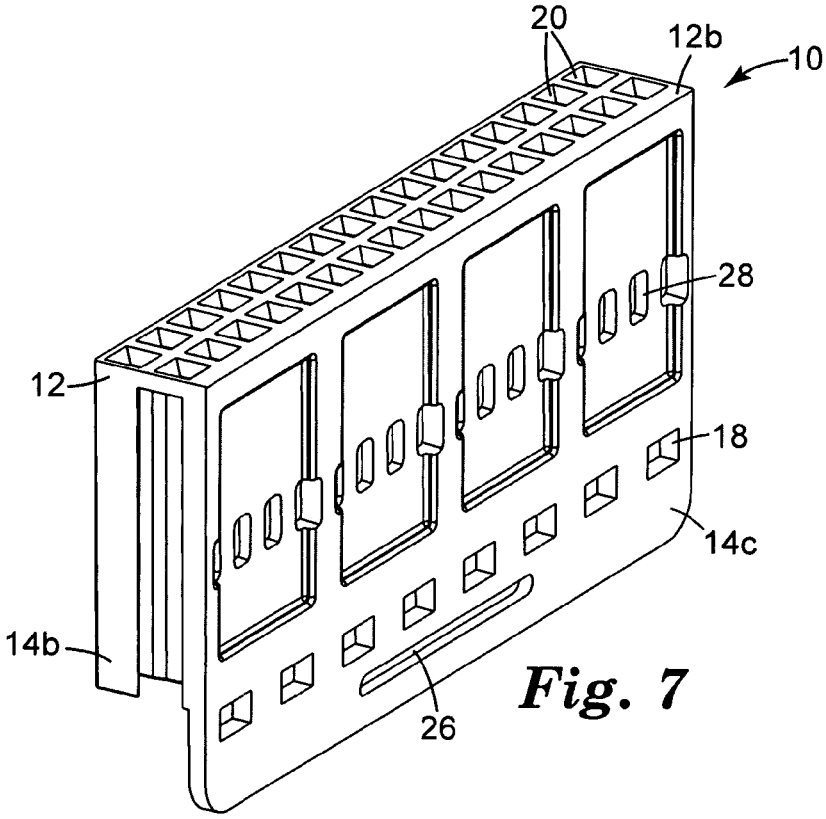

FIGS. 6 and 7 illustrate different perspective views of one exemplary embodiment of an insulating housing according to the present invention. Insulating housing 10 has a front exterior wall 12, laterally extending side exterior walls 14*a*, 14*b*, 14*c*, and 14*d* (hereafter collectively referred to as 14, unless otherwise indicated), and a plurality of laterally extending interior walls 16. Side exterior wall 14*c* has a set of retention clip apertures 18. It is to be understood that retention clip apertures 18 can be positioned in one or more of the side exterior walls 14. Retention clip apertures 18 preferably have a lead-in formed e.g. by chamfered edges to facilitate guidance and assembly of retention clip 32, illustrated in FIG. 10. Front exterior wall 12 has a plurality of pin insertion apertures 20 configured to receive contact pins 22 of pin header 8, illustrated in FIG. 19. Pin insertion apertures 20 preferably have a lead-in formed e.g. by chamfered edges to facilitate guidance and mating of contact pins 22 of pin header 8. As shown in FIGS. 6 and 7, side exterior wall 14*c* has slot 26. Slot 26 is configured to receive pull tab 56, illustrated in FIG. 17. It is to be understood that slot 26 is optional, that it can be positioned in one or more of the side exterior walls 14, and that it can have different geometries to accommodate different types of pull tabs. Insulating housing 10 can have more than one slot 26, e.g. in case more than one pull tab 56 is desired. Optionally, side exterior wall 14*c* has a set of terminated cable assembly retention feature apertures 28. It is to be understood that terminated cable assembly retention feature apertures 28 can be positioned in one or more of the side exterior walls 14. Terminated cable assembly retention feature apertures 28 preferably have a lead-in formed e.g. by rounded edges to facilitate proper assembly, retention, and removal of each terminated cable assembly 30, illustrated in FIG. 15.

Figure 8:
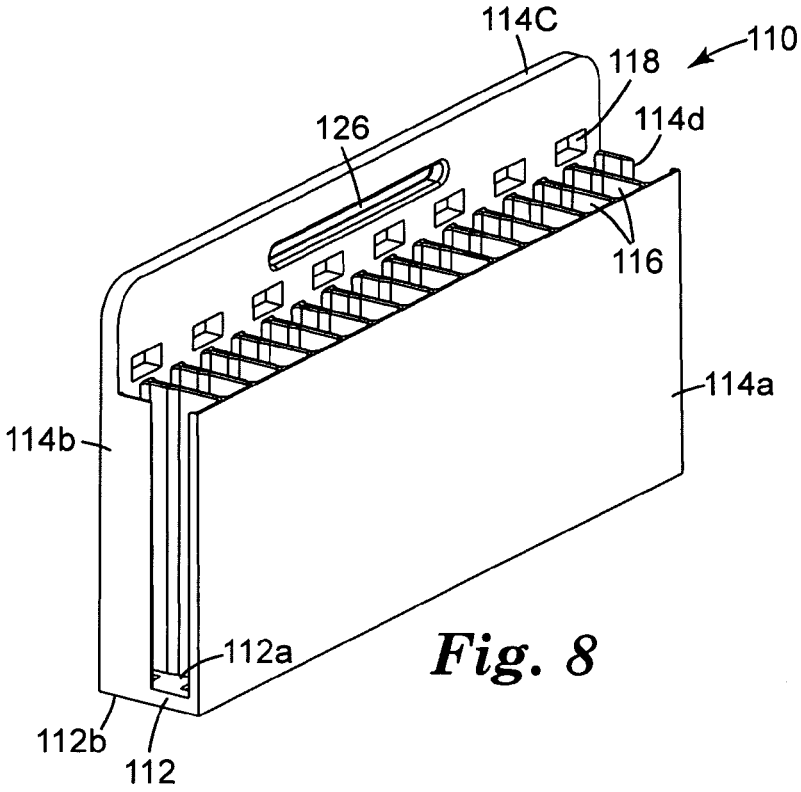
FIGS. 8 and 9 are perspective views of another exemplary embodiment of a carrier housing according to the present invention.
Figure 9:
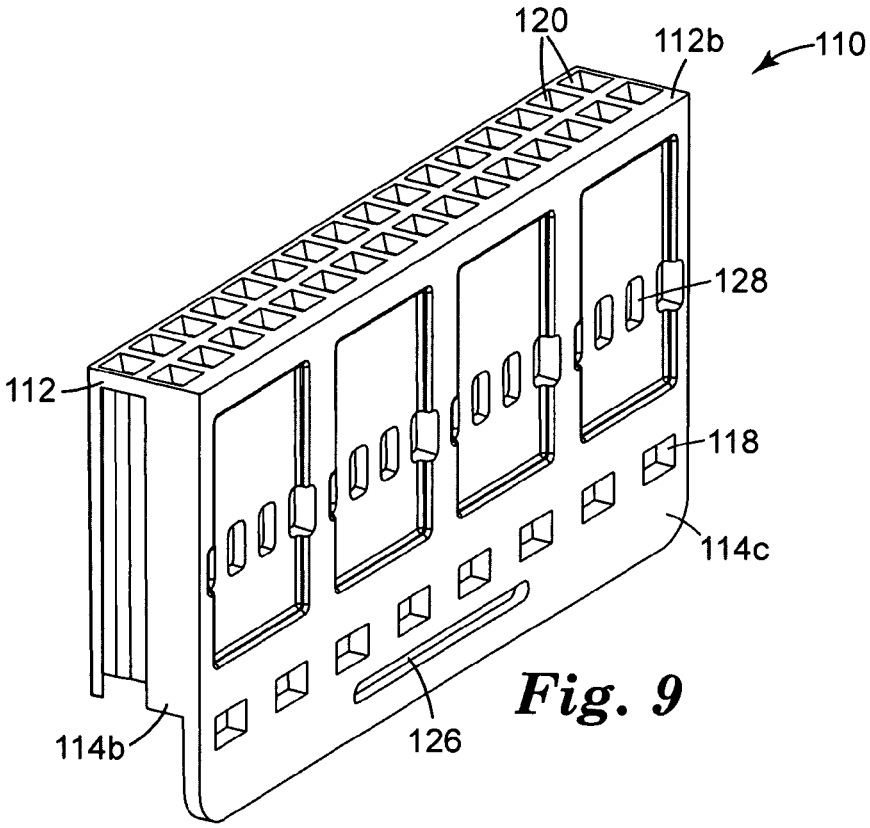

FIGS. 8 and 9 illustrate different perspective views of another exemplary embodiment of an insulating housing according to the present invention. Insulating housing 110 has a front exterior wall 112, laterally extending side exterior walls 114*a*, 114*b*, 114*c*, and 114*d* (hereafter collectively referred to as 114, unless otherwise indicated), and a plurality of laterally extending interior walls 116. Side exterior wall 114*c* has a set of retention clip apertures 118. It is to be understood that retention clip apertures 118 can be positioned in one or more of the side exterior walls 114. Retention clip apertures 118 preferably have a lead-in formed e.g. by chamfered edges to facilitate guidance and assembly of retention clip 132, illustrated in FIG. 11. Front exterior wall 112 has a plurality of pin insertion apertures 120 configured to receive contact pins 22 of pin header 8, illustrated in FIG. 19. Pin insertion apertures 120 preferably have a lead-in formed e.g. by chamfered edges to facilitate guidance and mating of contact pins 22 of pin header 8. As shown in FIGS. 8 and 9, side exterior wall 114*c* has slot 126. Slot 126 is configured to receive pull tab 56, illustrated in FIG. 17. It is to be understood that slot 126 is optional, that it can be positioned in one or more of the side exterior walls 114, and that it can have different geometries to accommodate different types of pull tabs. Insulating housing 110 can have more than one slot 126, e.g. in case more than one pull tab 56 is desired. Optionally, side exterior wall 114*c* has a set of terminated cable assembly retention feature apertures 128. It is to be understood that terminated cable assembly retention feature apertures 128 can be positioned in one or more of the side exterior walls 114. Terminated cable assembly retention feature apertures 128 preferably have a lead-in formed e.g. by rounded edges to facilitate proper assembly, retention, and removal of each terminated cable assembly 30, illustrated in FIG. 15. In one embodiment, insulating housing 10 and insulating housing 110 are used as a pair to allow side-to-side placement of electrical cable assemblies 6 into pin header 8 such that potentially all pin positions in pin header 8 can be used.

Figure 10:
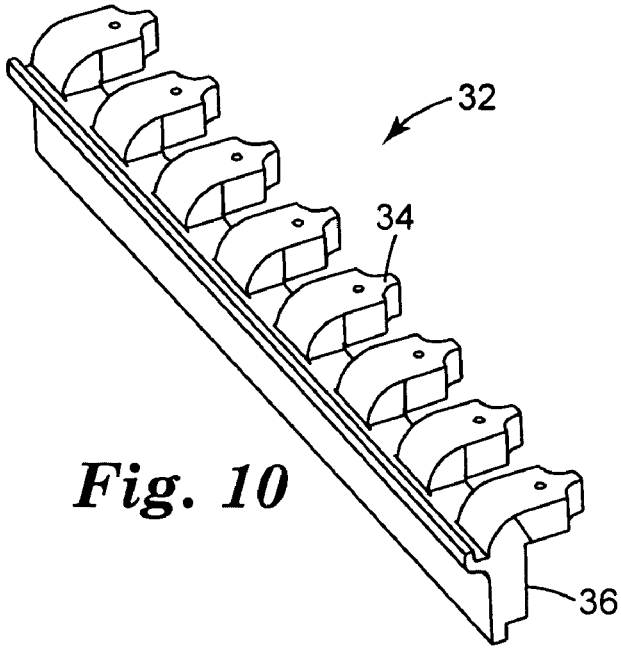
FIG. 10 is a perspective view of a retention clip according to the present invention.

FIG. 10 illustrates one exemplary embodiment of a retention clip according to the present invention. Retention clip 32 has a plurality of retention clip ribs 34 extending from back side 36. Retention clip ribs 34 are configured to mate with retention clip apertures 18 of insulating housing 10, as illustrated in FIG. 7. One of the functions of retention clip 32 and retention clip ribs 34 specifically is to retain terminated cable assemblies 30 in insulating housing 10. Retention clip 32 is typically an integrally molded piece of insulating material.

Figure 11:
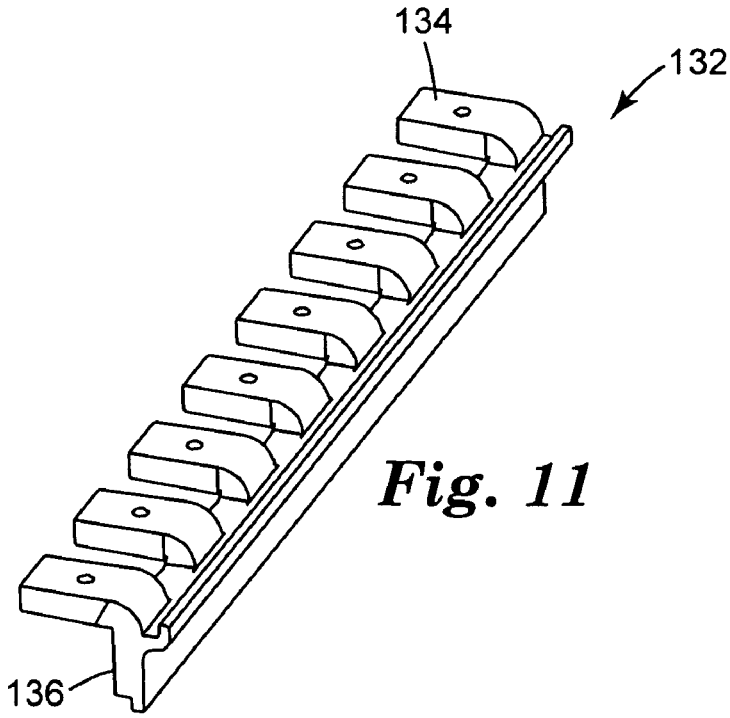
FIG. 11 is a perspective view of another exemplary embodiment of a retention clip according to the present invention.

FIG. 11 illustrates another exemplary embodiment of a retention clip according to the present invention. Retention clip 132 has a plurality of retention clip ribs 134 extending from back side 136. Retention clip ribs 134 are configured to mate with retention clip apertures 118 of insulating housing 110, as illustrated in FIG. 9. One of the functions of retention clip 132 and retention clip ribs 134 specifically is to retain terminated cable assemblies 30 in insulating housing 110. Retention clip 132 is typically an integrally molded piece of insulating material.

Figure 12:
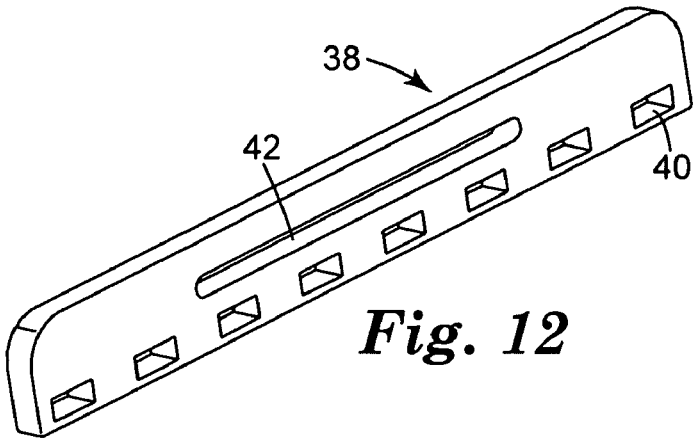
FIG. 12 is a perspective view of an exemplary embodiment of a retention bar according to the present invention.

FIG. 12 illustrates one exemplary embodiment of a retention bar according to the present invention. Retention bar 38 has a plurality of retention clip apertures. Retention clip apertures 40 preferably have a lead-in formed e.g. by chamfered edges to facilitate guidance and assembly of retention clip 132, illustrated in FIG. 11. One of the functions of retention bar 38 is to provide additional support to retain terminated cable assemblies 30 in insulating housing 110. As shown in FIG. 12, retention bar 38 has slot 42. Slot 42 is configured to receive pull tab 56, illustrated in FIG. 17. It is to be understood that slot 42 is optional and that it can have different geometries to accommodate different types of pull tabs. Retention bar 38 can have more than one slot 42, e.g. in case more than one pull tab 56 is desired. Retention bar 38 is typically an integrally molded piece of insulating material.

Figure 13:
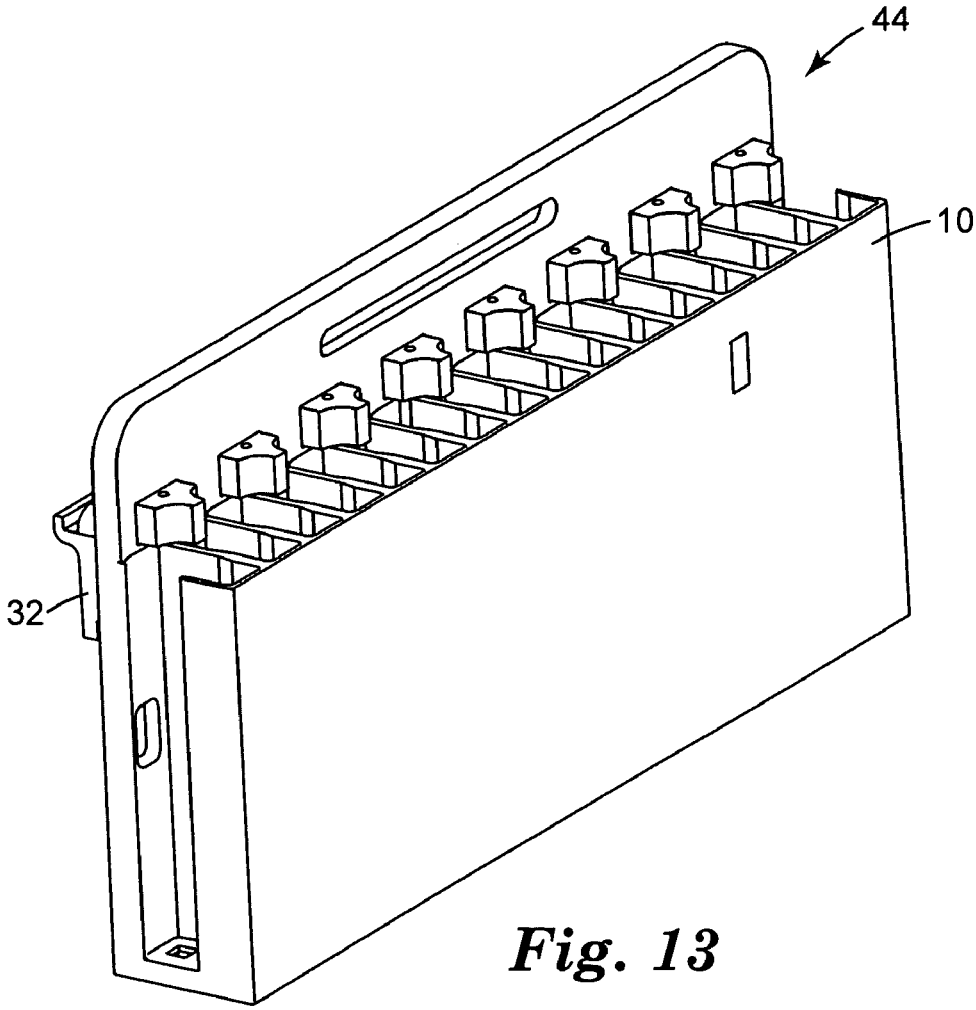
FIG. 13 is a perspective view of the assembly of the carrier housing of FIGS. 6 and 7 and the retention clip of FIG. 10.
Figure 14:
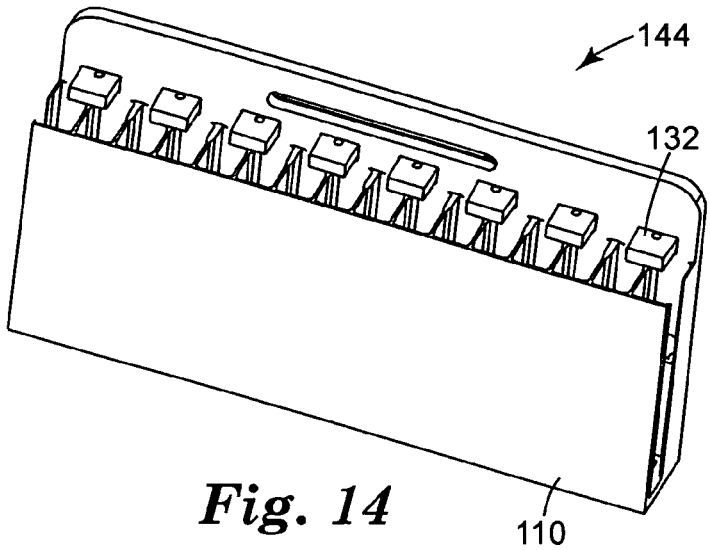
FIG. 14 is a perspective view of the assembly of the carrier housing of FIGS. 8 and 9 and the retention clip of FIG. 11.
Figure 15:
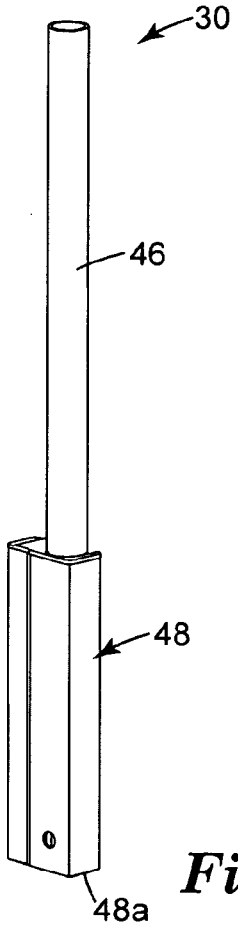
FIG. 15 is a perspective view of an exemplary embodiment of a terminated cable assembly that can be used in conjunction with the present invention.

FIG. 15 illustrates an exemplary embodiment of a terminated cable assembly that can be used in conjunction with carrier 44 and carrier 144, illustrated in FIG. 13 and FIG. 14 respectively. Terminated cable assembly 30 includes electrical cable 46 attached to termination device 48 through the use of a solder opening (not shown). The type of electrical cable used in this invention can be a single wire cable (e.g. single coaxial or single twinaxial) or a multiple wire cable (e.g. multiple coaxial, multiple twinaxial, or twisted pair). For use in conjunction with carrier 44, the terminated cable assemblies are inserted into insulating housing 10 such that the front face 48*a* of termination devices 48 abuts interior surface 12*a* of the front exterior wall 12 of insulating housing 10. Female contacts (not shown) lie along the longitudinal axis of termination device 48 and align with pin insertion apertures 20 of the front exterior wall 12 of insulating housing 10. Side exterior walls 14 and interior walls 16 help position termination devices 48. Optionally, terminated cable assembly 30 can include a retention feature such as a tab or bump (not shown) that will snap into terminated cable assembly retention feature apertures 28 to help retain terminated cable assembly 30 into the carrier. For use in conjunction with carrier 144, the terminated cable assemblies are inserted into insulating housing 110 such that the front face 48*a* of termination devices 48 abuts interior surface 112*a* of the front exterior wall 112 of insulating housing 110. Female contacts (not shown) lie along the longitudinal axis of termination device 48 and align with pin insertion apertures 120 of the front exterior wall 112 of insulating housing 110. Side exterior walls 114 and interior walls 116 help position termination devices 48. Optionally, terminated cable assembly 30 can include a retention feature such as a tab or bump (not shown) that will snap into terminated cable assembly retention feature apertures 128 to help retain terminated cable assembly 30 into the carrier.

Figure 16:
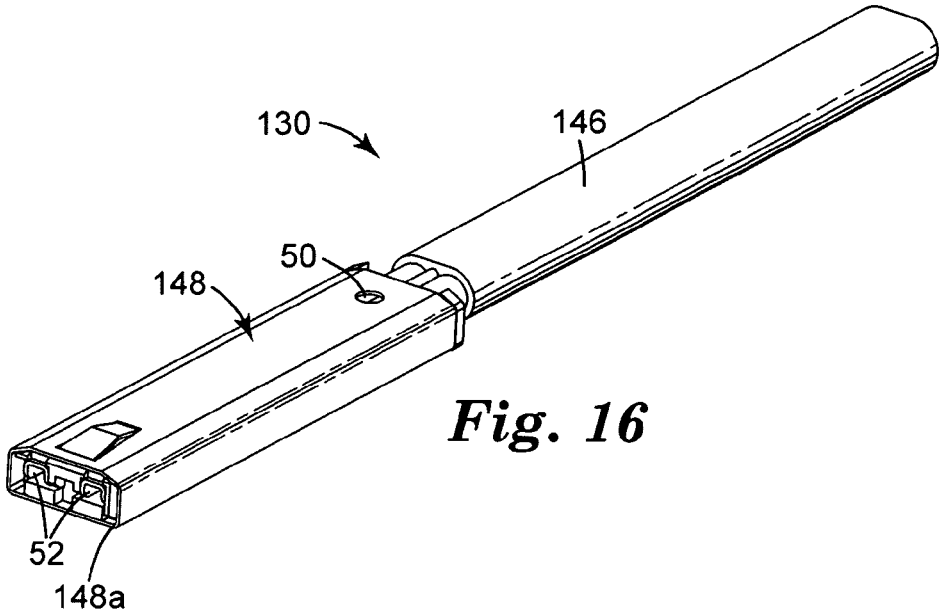
FIG. 16 is a perspective view of another exemplary embodiment of a terminated cable assembly that can be used in conjunction with the present invention.

FIG. 16 illustrates another exemplary embodiment of a terminated cable assembly that can be used in conjunction with carrier 44 and carrier 144, illustrated in FIG. 13 and FIG. 14 respectively. Terminated cable assembly 130 includes electrical cable 146 attached to termination device 148 through the use of solder opening 50. The type of electrical cable used in this invention can be a single wire cable (e.g. single coaxial or single twinaxial) or a multiple wire cable (e.g. multiple coaxial, multiple twinaxial, or twisted pair). For use in conjunction with carrier 44, the terminated cable assemblies are inserted into insulating housing 10 such that the front face 148*a* of termination devices 148 abuts interior surface 12*a* of the front exterior wall 12 of insulating housing 10. Female contacts 52 lie along the longitudinal axis of termination device 148 and align with pin insertion apertures 20 of the front exterior wall 12 of insulating housing 10. Side exterior walls 14 and interior walls 16 help position termination devices 148. Optionally, terminated cable assembly 130 can include a retention feature such as a tab or bump (not shown) that will snap into terminated cable assembly retention feature apertures 28 to help retain terminated cable assembly 130 into the carrier. For use in conjunction with carrier 144, the terminated cable assemblies are inserted into insulating housing 110 such that the front face 148*a* of termination devices 148 abuts interior surface 112*a* of the front exterior wall 112 of insulating housing 110. Female contacts 52 lie along the longitudinal axis of termination device 148 and align with pin insertion apertures 120 of the front exterior wall 112 of insulating housing 110. Side exterior walls 114 and interior walls 116 help position termination devices 148. Optionally, terminated cable assembly 130 can include a retention feature such as a tab or bump (not shown) that will snap into terminated cable assembly retention feature apertures 128 to help retain terminated cable assembly 130 into the carrier.

Figure 17:
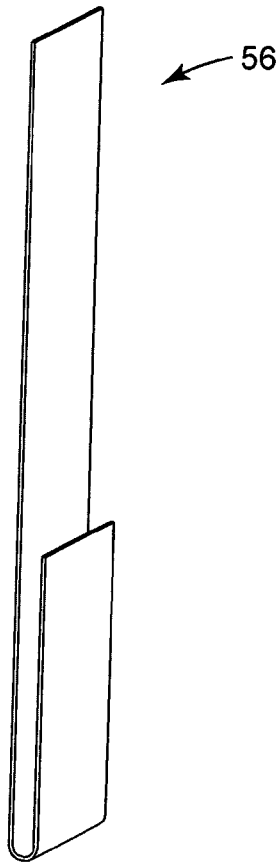
FIG. 17 is a perspective view of an exemplary embodiment of a pull tab that can be used in conjunction with the present invention.

FIG. 17 illustrates an exemplary embodiment of a pull tab for use in conjunction with the present invention. Pull tab 56 serves to ease manual removal of electrical cable assembly 6 from pin header 8. Pull tab 56 is typically an integrally formed piece of insulating material.

Figure 18:
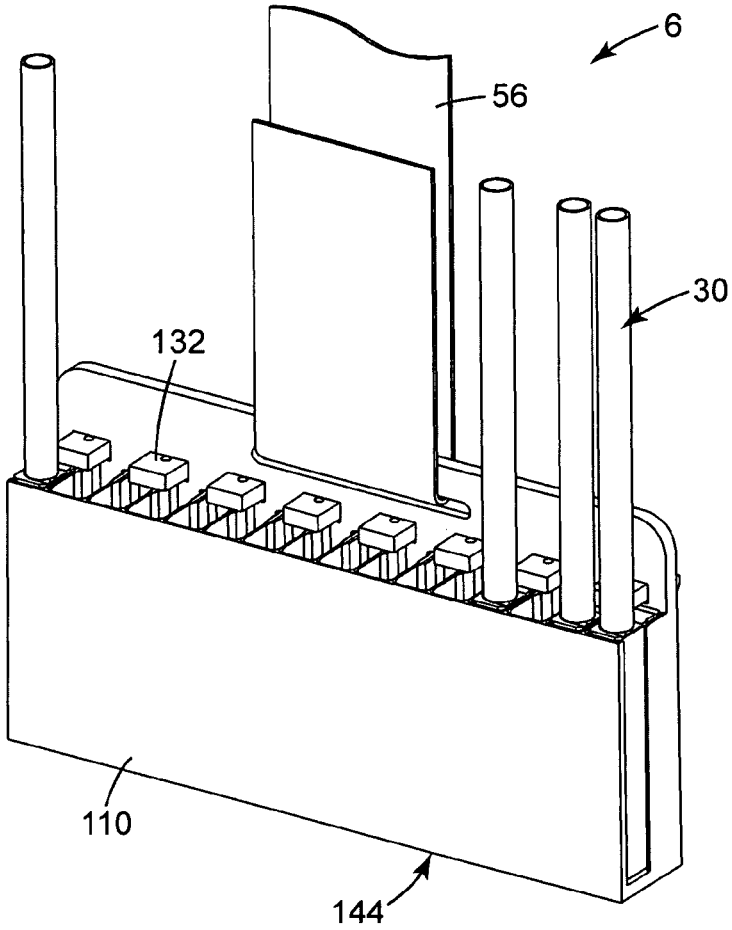
FIG. 18 is a perspective view of the assembly of the carrier housing of FIGS. 8 and 9, a plurality of terminated cable assemblies as the one of FIG. 15, the retention clip of FIG. 11, and the pull tab of FIG. 17.

FIG. 18 illustrates an exemplary embodiment of an electrical cable assembly according to the present invention. Electrical cable assembly 6 includes a plurality of terminated cable assemblies 30 (4 shown), carrier 144 including insulating housing and retention clip 132, and pull tab 56.

Figure 19:
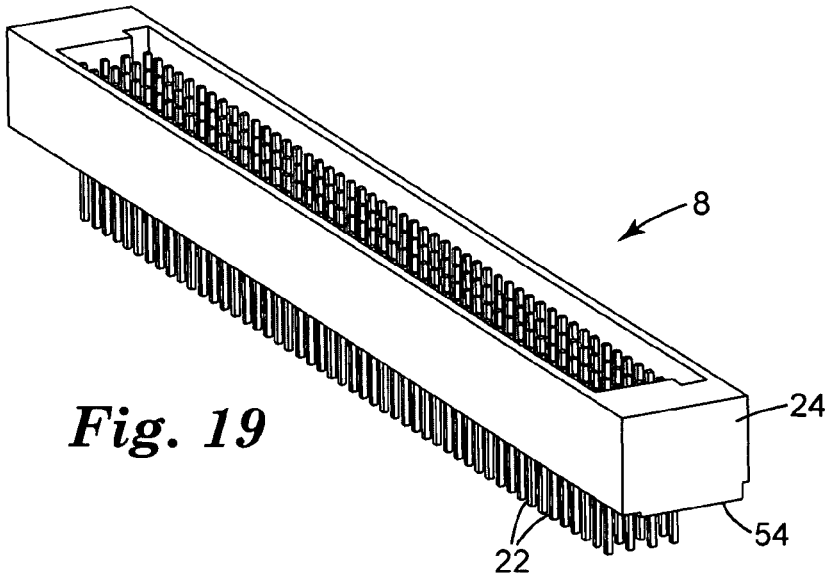
FIG. 19 is a perspective view of an exemplary embodiment of a header that can be used in conjunction with the present invention.

FIG. 19 illustrates an exemplary embodiment of a pin header according to the present invention. Pin header 8 includes insulating housing 24 and a plurality of contact pins 22. Insulating housing 24 includes a bottom wall 54 having a top surface and a bottom surface (not shown). Bottom wall 54 is formed to include a plurality of pin insertion windows for contact pins 22, where contact pins 22 extend through bottom wall 54. Insulating housing 24 is typically an integrally molded piece of insulating material. For use in conjunction with carrier 44, pin header 8 is mated with electrical cable assembly 6 such that the exterior surface 12*b* of the front exterior wall 12 of insulating housing 10 is in contact with the top surface of bottom wall 54. For use in conjunction with carrier 144, pin header 8 is mated with electrical cable assembly 6 such that the exterior surface 112*b* of the front exterior wall 112 of insulating housing 110 is in contact with the top surface of bottom wall 54.

Figure 20:
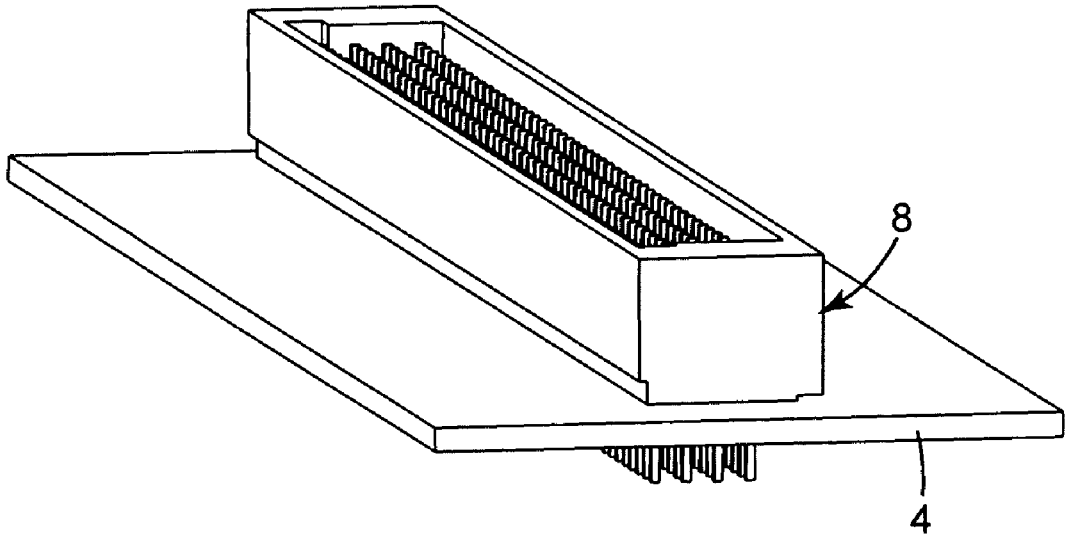
FIG. 20 is a perspective view of the assembly of the header of FIG. 19 and a printed circuit board.

FIG. 20 illustrates pin header 8 assembled to printed circuit board 4.

What is claimed is:

1. An electrical connector system comprising:

a plurality of electrical connector assemblies comprising:

a carrier configured to receive a plurality of terminated cable assemblies, the carrier comprising:

an insulating housing having a front exterior wall, laterally extending side exterior walls, a plurality of laterally extending interior walls, at least one set of retention clip apertures disposed on at least one of the side exterior walls, and a plurality of pin insertion apertures disposed on the front exterior wall;

wherein the side exterior walls are configured to enable side-to-side and end-to-end placement; and at least one retention clip having a plurality of retention clip ribs extending from a back, the retention clip disposed in the insulating housing such that the retention clip ribs mate with the retention clip apertures in the insulating housing;

a plurality of terminated cable assemblies, each terminated cable assembly comprising an electrical cable attached to a termination device, wherein the termination device has a front face and at least one female contact lying substantially parallel to a longitudinal axis of the terminated cable assembly;

wherein the plurality of terminated cable assemblies is disposed in the carrier such that the front face of each termination device is in contact with the interior surface of the housing; and a pin header configured to receive the plurality of electrical connector assemblies.

2. The electrical connector system of claim 1 further comprising a printed circuit board attached to the pin header, wherein the printed circuit board, pin header, and plurality of electrical connector assemblies are in electrical communication.

3. The electrical connector system of claim 1, wherein the carrier further comprises a slot disposed on at least one of the exterior walls, the slot configured to receive a pull tab.

4. The electrical connector system of claim 1, wherein the carrier further comprises at least one set of terminated cable assembly retention feature apertures disposed on at least one of the side exterior walls.

5. The electrical connector system of claim 1, wherein the carrier further comprises a retention bar having a plurality of retention clip apertures, the retention bar disposed in the insulating housing such that the retention clip apertures in the retention bar mate with the retention clip ribs.

6. The electrical connector system of claim 5, wherein the retention bar further comprises a slot configured to receive a pull tab.

7. The electrical connector system of claim 1, wherein each electrical connector assembly further comprises a pull tab configured to remove the electrical connector assembly from the pin header.

* * * * *